United States Patent [19]

Lindsay

[11] 3,996,818

[45] Dec. 14, 1976

[54] LAWN MOWER AND GARDEN TOOL SHARPENER

[76] Inventor: Raymond S. W. Lindsay, 2032 Elkins Place, Arcadia, Calif. 91006

[22] Filed: Feb. 13, 1976

[21] Appl. No.: 657,967

Related U.S. Application Data

[63] Continuation of Ser. No. 559,759, March 19, 1975, abandoned.

[52] U.S. Cl. ..... 76/82.1
[51] Int. Cl.[2] ..... B21K 19/00
[58] Field of Search ..... 76/82.1, 83, 82.2; 51/173

[56] References Cited

UNITED STATES PATENTS

| | | | |
|---|---|---|---|
| 458,004 | 8/1891 | Smith | 76/82.2 |
| 1,359,192 | 11/1920 | Palas | 76/82.1 |
| 1,999,847 | 4/1935 | Patterson | 76/82.1 |
| 2,141,359 | 12/1938 | McKittrick | 76/82.1 |

*Primary Examiner*—James L. Jones, Jr.
*Attorney, Agent, or Firm*—Sellers and Brace

[57] ABSTRACT

A hand-held tool for sharpening tool blades including blades of both reel and rotary type lawn mowers. The tool supports a plurality of cutters which are usable selectively to sharpen blades of different types. The tool includes guide means cooperating with each cutter to support the tool in its more effective sharpening position.

12 Claims, 7 Drawing Figures

LAWN MOWER AND GARDEN TOOL SHARPENER

This application is a continuation of my application for United States Letters Patent Ser. No. 559,759, filed Mar. 19, 1975, now abandoned, entitled LAWN MOWER AND GARDEN TOOL SHARPENER.

This invention relates to blade sharpeners, and more particularly to an improved hand-held tool supporting cutters of different types each cooperating with guide surfaces of the tool to support the cutter in proper sharpening position for the particular blade being sharpened.

The main body of the invention tool is molded in two interfitting principal parts shaped to support separate cutters including, for example, a tool steel cutter and a file cutter each properly oriented for the most efficient and effective sharpening of typical types of blades. More particularly, these cutters are selected and arranged for efficient use in reconditioning both the reel blades and the cutting bar blades of a reel type lawn mower as well as the rotary blade of a rotary lawn mower. Either cutter may also be used in sharpening a wide variety of conventional garden tools. Both cutters may be inverted or reversed to present either a fresh cutting edge or fresh file teeth, depending upon the cutter reversed, thereby materially prolonging the service life of the tool before replacing the cutters. The tool also includes a hand grip and simple, readily adjusted means for locking the hand grip in any one of many different adjusted positions.

Accordingly, it is a primary object of this invention to provide a simple, rugged, highly versatile blade sharpening tool for sharpening any of a wide variety of blades.

Another object of the invention is the provision of a hand-held sharpening tool specially designed for sharpening the reel blades and knife bar of a reel type mower as well as the rotating blade of a rotary mower.

Another object of the invention is the provision of a hand-held sharpening tool having a plurality of cutters each associated with guide means for supporting the tool properly while is use to sharpen different types of blades.

These and other more specific objects will appear upon reading the following specification and claims and upon considering in connection therewith the attached drawing to which they relate.

Referring now to the drawing in which a preferred embodiment of the invention is illustrated:

Figure 1:
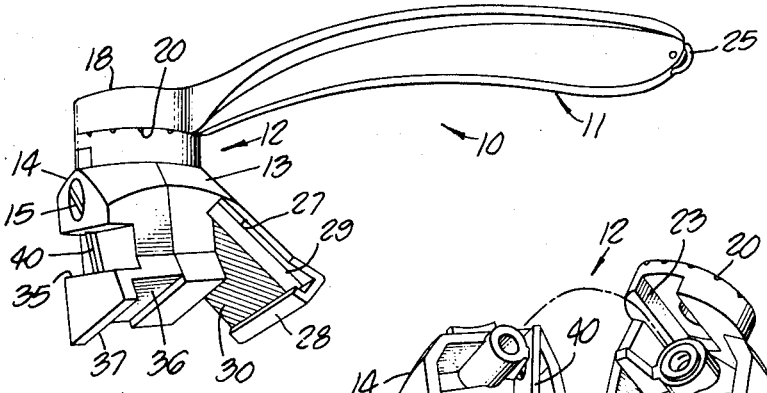
FIG. 1 is a perspective view of an illustrative embodiment of the invention sharpening tool.

Referring more particularly to FIG. 1, there is shown an illustrative embodiment of the invention sharpening tool, designated generally 10, having a hand grip 11 secured to the main body 12. This main body may be molded of suitable material such as tough, high strength plastic and, as here shown, is formed in two parts 13,14 held clamped together by a cap screw 15.

Figure 3:
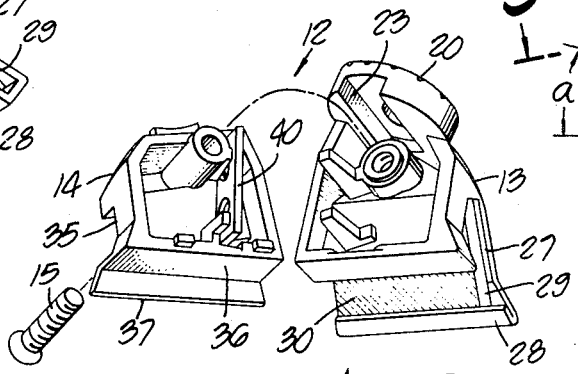
FIG. 3 is an exploded view of the main body of the tool and showing the means for rigidly supporting the steel cutter.
Figure 4:
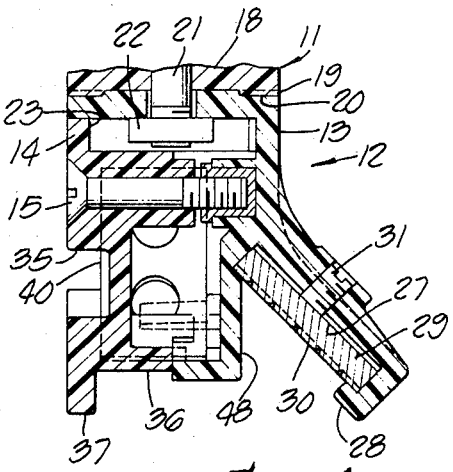
FIG. 4 is a cross-sectional view on an enlarged scale taken along line 4—4 on FIG. 2.

Hand grip 11 is formed with a disc-like end lug 18 formed on its underside with one or more radial ribs 19 (FIG. 4) which seat in complementally-shaped grooves 20 (FIG. 1) to hold the hand grip 11 in a desired adjusted position on the main body. A fastening bolt 21 extends through the center of portion 18 and into mating engagement with a nut 22 (FIG. 4) held against rotation by a recess 23 (FIG. 3) interiorly of main body part 13 (FIGS. 3 and 4). The outer end of hand grip 11 is preferably provided with a glass cutter 25.

Referring now to FIG. 1 it is pointed out that main body part 13 is formed along one lateral side with an open-ended V-shaped groove 27 having an inturned lip 28 along its free edge. A short length of a cutter element 29 having file teeth 30 on its opposite sides is held firmly seated in the V-shaped groove by a set screw 31 (FIG. 4). It will be understood that cutter element 29 is readily removed and inverted and reversed end-to-end to present different areas of teeth 30 to a blade to be sharpened.

The opposite lateral face of tool 10 is provided with a channel-shaped groove 35, the longitudinal axis of which lies at an acute angle A (FIG. 2) to the plane of a flat guide surface 36 for tool 10 on the underside of main body part 14. The outer longitudinal edge of guide surface 36 has a low height guide flange 37 the purpose of which will be explained more fully presently.

Figure 2:
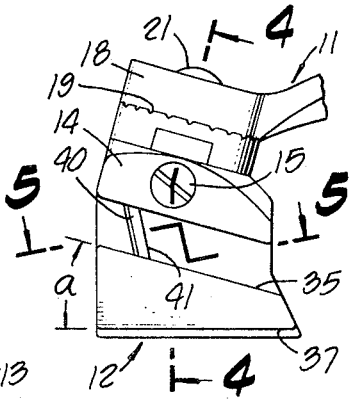
FIG. 2 is a side elevational view of the main body of the tool.
Figure 5:
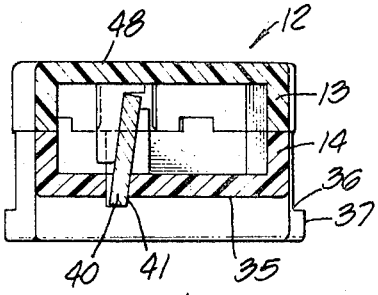
FIG. 5 is a cross-sectional view on an enlarged scale taken along line 5—5 on FIG. 2.

A rectangular tool steel cutter 40 is firmly seated within cooperating channels formed interiorly of the main body parts 13,14 with one of its several sharp corner edges projecting through a slot crosswise of the bottom of groove 35. As is best shown in FIGS. 2 and 5, cutter 40 extends crosswise of the bottom of groove 35. Cutter 40 is herein shown as inclined to two planes at right angles to one another and each lying acutely to a plane perpendicular to the bottom of groove 35. In consequence, the cutting corner edge 41 (FIGS. 2 and 5) is spaced a slightly greater distance from the bottom of the groove than the adjacent other corner edge of the cutter exposed within the groove 35.

Cutter 40 is rectangular and seatable in many different positions within the positioning channels therefor formed interiorly of part 13 and 14. Thus, the cutter can be inverted end for end as well as rotated about its longitudinal axis so as to expose different portions of its sharp cutting corner edges crosswise of groove 35.

In use let it be assumed that it is desired to sharpen the edge of blade 45 of a typical rotary mower 46. The file type cutter 29 is preferably used for this purpose and tool 10 is placed astride the cutting edge 47 of blade 45 in the manner shown in FIG. 6. Groove sidewall 48 (FIG. 4) is held flush against the exterior face of blade 45 thereby presenting the bevelled cutting edge 47 of the blade parallel to the file teeth 30. It will therefore be clear that the sidewalls 48 provide a guide surface for supporting cutter 29 in the proper position to sharpen blade edge 47 as the tool is pulled along the edge of this blade with the handle 11 preferably adjusted to be generally parallel to the edge 47.

Figure 6:
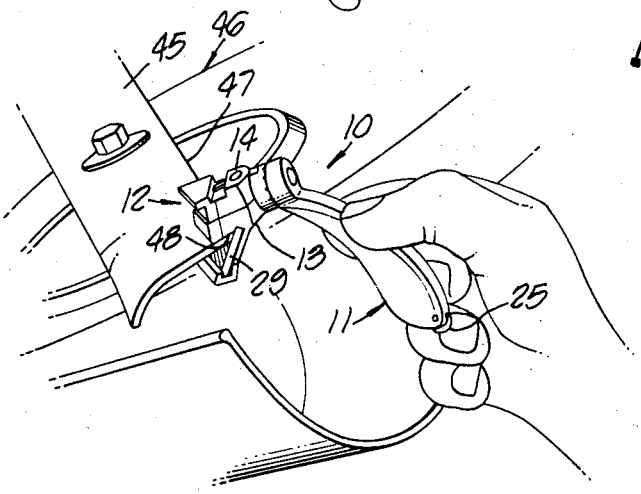
FIG. 6 is a perspective view showing the tool in use to sharpen the blade of a rotary mower.
Figure 7:
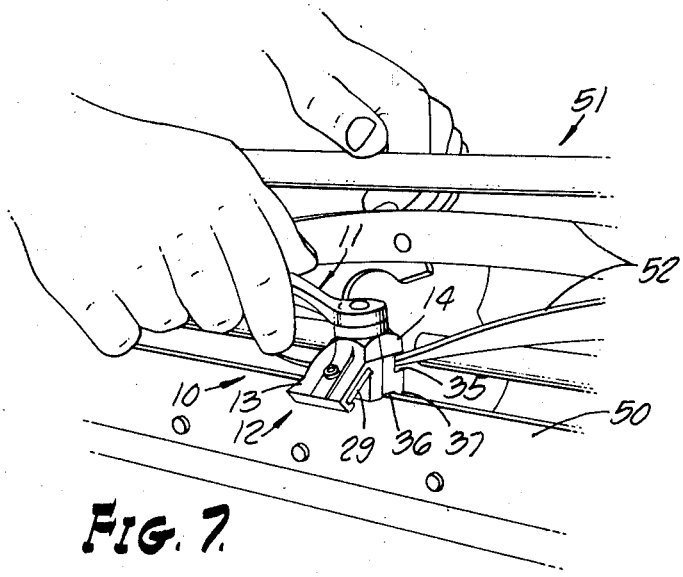
FIG. 7 is a fragmentary perspective view showing the tool in use to sharpen the reel of a reel type lawn mower.

V-groove 27 and the cutter 29 is used in the same manner to sharpen the edge of knife bar 50 of a reel-type mower 51 (FIG. 7). The tool is not shown in use for this purpose in FIG. 7 since the showing in FIG. 6 is believed sufficient to illustrate its mode of use in sharpening knife bar 50.

When using tool 10 to sharpen the edge of reel blades 52 the knife bar is first adjusted outwardly away from the reel to permit the latter to rotate freely. The tool is then placed astride the edge of the knife bar with the guide surface 36 resting against the cutting edge of the knife bar and with flange 37 in flush contact with one face of the knife bar. At the same time the edge of a reel blade 52 is seated in the channel-shaped groove 35 of tool 10 with the cutting edge 41 of cutter 40 bearing against the transverse edge of the reel blade. The operator now proceeds to draw the tool toward him along the knife bar as the reel rotates with the edge of a reel blade in firm sharpening contact with edge 41 of the cutter. A similar number of passes of the sharpening tool is made along the edge of each reel blade to assure sharpening each by a like amount.

Although the tool is not shown in use to sharpen the blade of any other tool it will be readily apparent that the tool is equally suitable to sharpen the blades of a wide variety of garden tools.

While the particular lawn mower and garden tool sharpener herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A hand-held sharpening tool for sharpening reel type lawn mowers, said tool having a main body provided with an elongated handgrip, a channel-shaped blade seating groove opening outwardly from one lateral side of said main body and extending generally parallel to and underlying said handgrip, said main body having a rectangular smooth-surfaced blade sharpening cutter secured therein with one portion thereof projecting outwardly through the bottom of said groove and lying in a plane generally normal to the bottom of said groove, the portion of said cutter projecting into said groove having one cutting corner edge extending crosswise of the bottom of said groove, rigid guide means on said main body engageable only with the cutting edge portion of a lawn mower knife bar and adapted to support said main body with one cutting corner edge only of said cutter positioned to sharpen the edge of a mower reel blade as said tool is drawn along a mower knife bar undergoing sharpening with said one cutting corner edge of said cutter held pressed crosswise of and against the edge of the mower reel blade.

2. A mower sharpening tool as defined in claim 1 characterized in that said channel-shaped groove extends at an acute angle to said rigid guide means.

3. A mower sharpening tool as defined in claim 1 characterized in that the cutting edge of said cutter extends crosswise of said channel-shaped groove and in a plane making an acute angle with a plane normal to the bottom of said groove.

4. A sharpening tool as defined in claim 1 characterized in that said main body is molded in two principal parts each shaped to interfit with one another and cooperating in the assembled position thereof to hold said sharpening cutter immovably assembled therebetween with its cutting edge projecting through the bottom of said channel-shaped groove, and means holding said two main body parts assembled about said cutter.

5. A sharpening tool as defined in claim 1 characterized in the provision of means for holding said hand grip adjustably assembled to said main body.

6. A sharpening tool as defined in claim 1 characterized in that said main body includes an open ended V-shaped groove, means for clamping a short length of a file against one interior surface of said V-shaped groove with the file teeth parallel to the bevel-cutting edge of a mower knife bar when the other interior sidewall of said V-shaped groove is held flush against the outer face of the mower knife bar, whereby the bevel edge of the knife bar can be sharpened as said tool is drawn therealong with the file teeth pressed against said bevel edge.

7. A sharpening tool as defined in claim 1 characterized in that said cutter comprises a rectangular strip having a blade cutting edge along the perimeter thereof, and said cutter being selectively clampable within said main body with any of several of said cutting edges in position to engage and sharpen a blade as said cutter is drawn lengthwise of and in contact therewith.

8. A sharpening tool as defined in claim 7 characterized in that said cutter is inclined acutely in planes at right angles to a plane normal to the bottom of said channel-shaped groove.

9. A sharpening tool as defined in claim 1 characterized in that said guide means for supporting said tool on the edge of a mower knife bar lies in a plane at an acute angle to the longitudinal axis of said channel-shaped groove.

10. A hand-held sharpening tool having first and second blade sharpening cutters mounted thereon for selective use in sharpening blades, said tool having a molded plastic main body provided with a hand grip on one side thereof, a flanged tool guide surface on said main body on the side thereof remote from said hand grip, one of the opposite lateral sides of said main body having a channel-shaped groove and the other lateral side having a V-shaped groove opening toward the plane of said tool guide surface, a cutter having a plurality of sharp cutting corner edges a selected one of which projects through the bottom of said channel-shaped groove, said one selected cutting corner edge extending crosswise of said groove and being effective to sharpen the edge of a lawn mower reel blade as said tool is drawn therealong while said flanged tool guide surface rests against the edge of the mower knife bar, and a file type second cutter mounted along one inner sidewall of said V-shaped groove and adapted to sharpen the knife bar of a rotary reel type lawn mower as said tool is passed therealong with the other sidewall of said V-shaped groove resting against the outer face of said cutting bar.

11. A sharpening tool as defined in claim 10 characterized in that the longitudinal axis of said channel-shaped groove lies at an acute angle to said tool guide surface.

12. A sharpening tool as defined in claim 10 characterized in that said cutter is selectively mountable in said main body with any selected cutting edge thereof positioned to engage and sharpen a reel blade.

* * * * *